United States Patent [19]

Fink

[11] 3,932,052

[45] Jan. 13, 1976

[54] ROLLER ATTACHMENT FOR TRUCKS

[75] Inventor: Robert Fink, Youngstown, Ohio

[73] Assignee: Inglis Nurseries Inc., Youngstown, Ohio

[22] Filed: Jan. 9, 1975

[21] Appl. No.: 539,931

Related U.S. Application Data

[63] Continuation-in-part of Ser. No. 388,480, Aug. 15, 1973, Pat. No. 3,895,880.

[52] U.S. Cl. ..... 404/128; 180/20

[51] Int. Cl.[2] ..... E01C 19/26

[58] Field of Search ..... 404/103, 128, 130; 172/527, 537; 180/20; 280/150 A

[56] References Cited

UNITED STATES PATENTS

| | | | |
|---|---|---|---|
| 1,458,751 | 6/1923 | Gailor | 180/20 |
| 2,613,955 | 10/1952 | White | 280/150 A |
| 2,762,276 | 9/1956 | Mauch | 404/103 |
| 2,962,950 | 12/1960 | Martin | 404/128 |
| 3,071,051 | 1/1963 | Martin | 404/128 |
| 3,665,823 | 5/1972 | Chaney et al. | 404/128 |

*Primary Examiner*—Mervin Stein
*Assistant Examiner*—Steven Hawkins
*Attorney, Agent, or Firm*—Webster B. Harpman

[57] ABSTRACT

A roller attachment for dump trucks has one or more road rollers mounted on a shaft which in turn is carried on the end of a pair of hydraulic piston and cylinder assemblies mounted on a beam positioned transversely of the truck and detachably secured to the frame thereof. Actuation of the hydraulic piston and cylinder assemblies from the hydraulic system of the dump truck moves the roller toward and away from a road surface so that when the roller is engaged on the road surface and the truck is moved forwardly and backwardly the roller will compact materials therebeneath.

4 Claims, 3 Drawing Figures

ROLLER ATTACHMENT FOR TRUCKS

This is a continuation in part of my application Ser. No. 388,480, filed Aug. 15, 1973.

BACKGROUND OF THE INVENTION

1. Field of the Invention:

This invention relates to a roller attachment for a dump truck so that the weight of the dump truck and material therein may be used to weight the roller in a compacting rolling action.

2. Description of the Prior Art:

Prior devices of this type have mounted rollers on trailing arm assemblies secured to truck axles and frames and employed hydraulic piston and cylinders for moving the trailing arms toward and away from the truck. (See for example U.S. Pat. Nos. 2,962,950 and 3,071,051). A fixed mounting of a roller on a truck is disclosed in U.S. Pat. No. 1,458,751 and further proposals have been made to mount rollers on spreader boxes and the like as disclosed in U.S. Pat. Nos. 2,258,205 and 2,762,276.

This invention eliminates the problems found with the prior art devices and discloses a more practical and conveniently operated effective roller attachment for a dump truck.

SUMMARY OF THE INVENTION

A roller attachment for a dump truck includes extensions secured to the truck frame, a transversely positioned hollow beam detachably secured to the extensions, hydraulic piston and cylinder assemblies on the beam movably positioning a transverse shaft and rollers thereon directly beneath the beam so that when the hydraulic piston and cylinder assemblies are connected to the hydraulic system of the dump truck the roller may be moved downwardly into engagement with a roadway and upon movement of the dump truck will roll and compact material such as for example patching material in holes in the roadway. Power operated jacks on the roller attachment adjustably position the device relative to the truck to simplify attaching and removing the device.

DESCRIPTION OF THE PREFERRED EMBODIMENT

Figure 1:
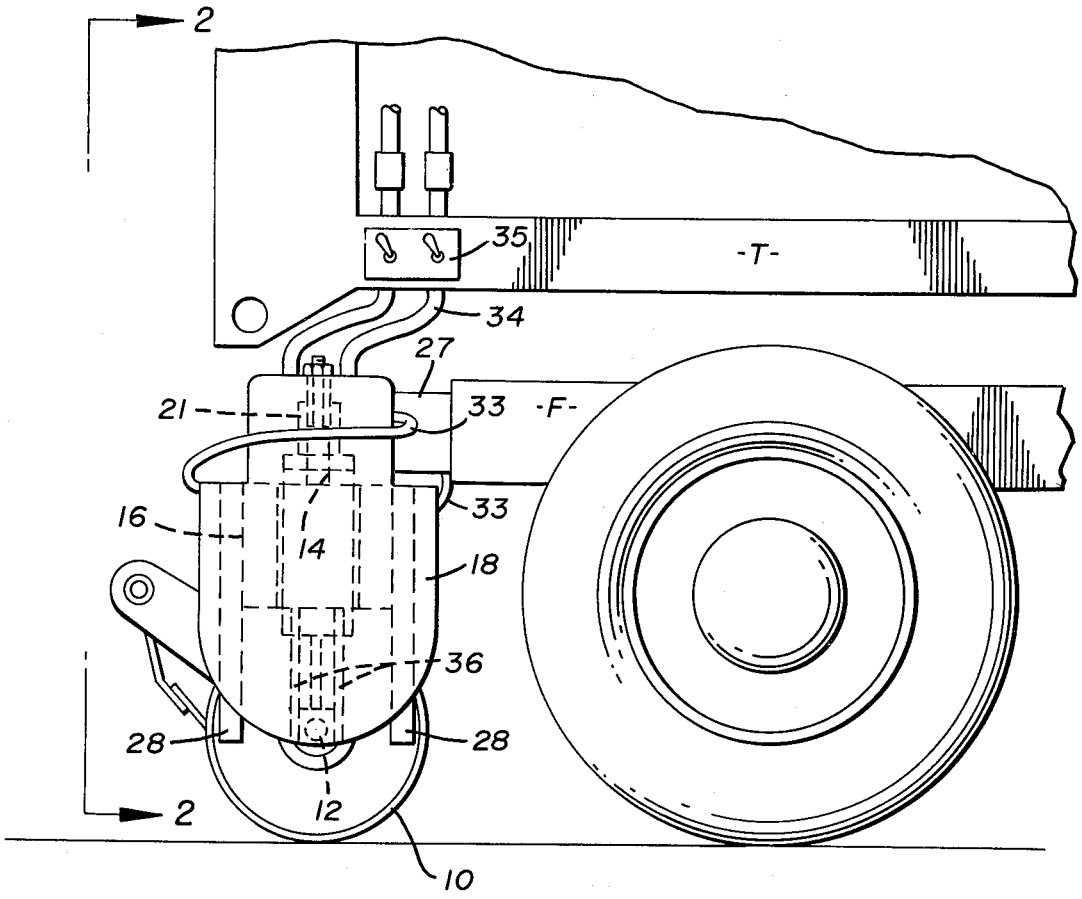
FIG. 1 is a side elevation of a portion of a dump truck showing the roller attachment in position thereon.
Figure 2:
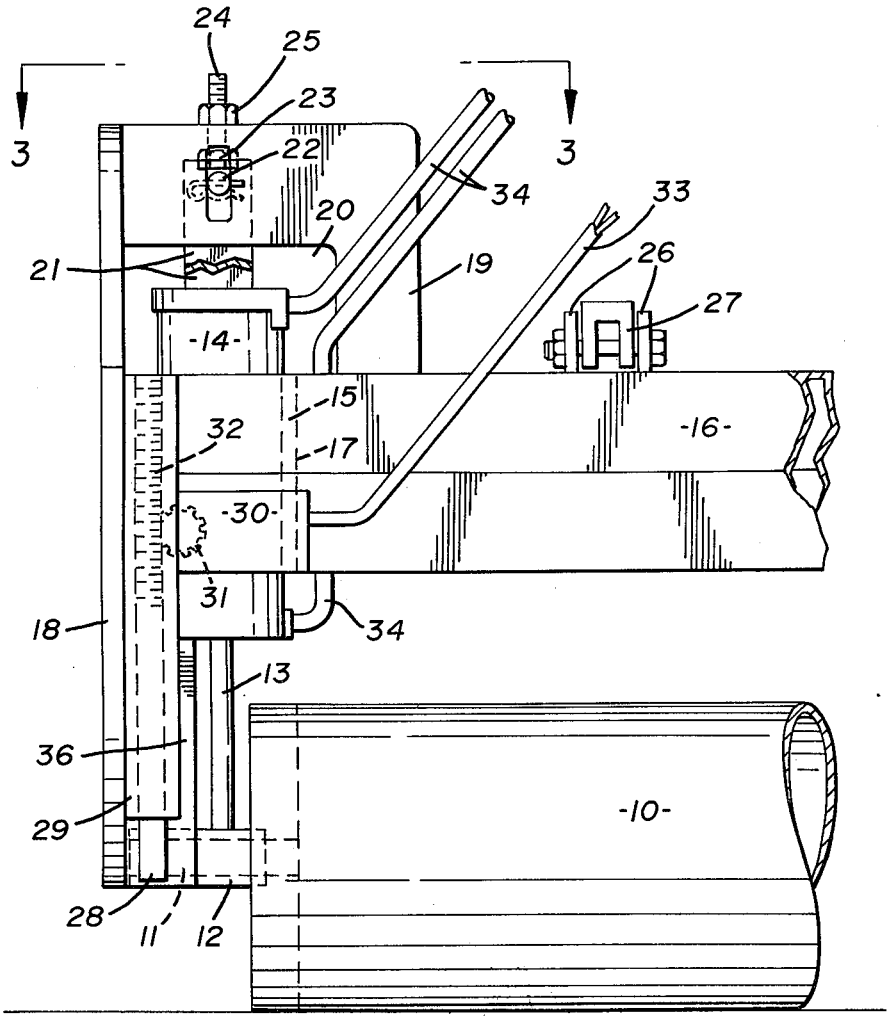
FIG. 2 is an enlarged rear elevational view of one end of the roller attachment on line 2—2 of FIG. 1.

By referring to FIGS. 1 and 2 of the drawings, it will be seen that the roller attachment for trucks as disclosed herein consists of a roller 10 rotatably positioned on a transverse shaft 11 with the ends of the transverse shaft 11 being journeled in bearings 12 on the lower ends of a pair of piston rods 13 which are parts of a pair of piston and cylinder assemblies 14. The piston and cylinder assemblies 14 are positioned in openings 15 in the ends of a transversely positioned hollow beam 16 which forms a tank. The openings 15 in the ends of the hollow beam 16 are defined by sleeves 17 and the ends of the hollow beam 16 are closed by plates 18.

The hollow beam 16 is preferably formed by welding a pair of channels to one another in oppositely disposed relation and subsequently welding the end plates 18 thereto. A pair of oppositely disposed, right angular shaped brackets 19 are positioned on the upper surface of the hollow beam 16 adjacent each end thereof and secured thereto and to the uppermost portions of the end plates 18 as by welding. The right angular brackets 19 define cut away areas 20, one at each end of the hollow beam 16 and above the openings 15 therethrough and therefore accommodate the upper portions of the piston and cylinder assemblies 14. Each of the pairs of piston and cylinder assemblies 14 have a pair of extensions 21 on their uppermost ends which are positioned on either side of the upper horizontal portion of the right angular bracket 19, a pin 22 having a perpendicular threaded portion 24 thereon is positioned through openings in the extensions 21, the right angular bracket 19 and positioned in the slot 23 and a nut 25 is affixed to the threaded perpendicular portion 24 so that by rotating the same the piston and cylinder assembly 14 can be moved vertically.

Figure 3:
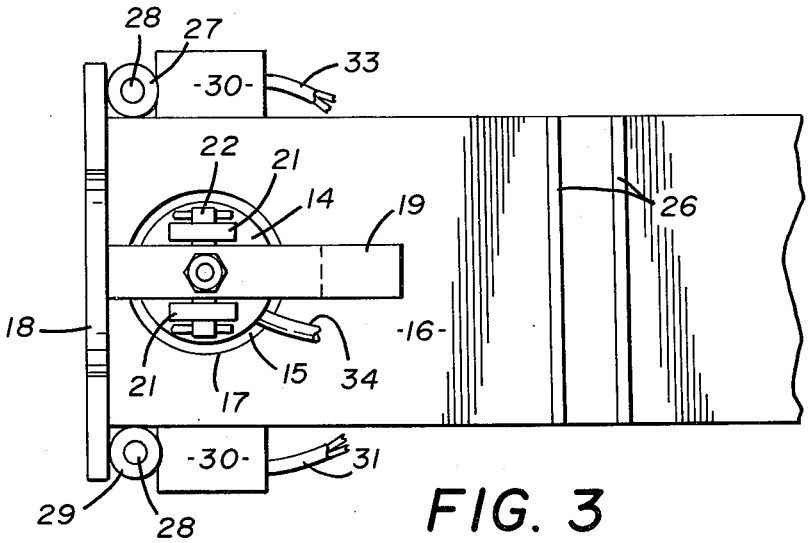
FIG. 3 is a top plan view of the roller attachment on line 3—3 of FIG. 2.

In FIG. 1 of the drawings, the right hand end of the roller attachment for trucks may be seen positioned beneath the dump body of the truck and in FIGS. 2 and 3 the left hand end thereof is illustrated and it will occur to those skilled in the art that the opposite ends of the hollow beam 16 each have a piston and cylinder assembly 14 arranged as hereinbefore described.

The hollow beam 16 is also provided with two pairs of upstanding flanges 26 arranged to be positioned on either side of horizontally disposed extension members 27 which in turn are attached to the frame F of a truck T as seen in FIG. 1 of the drawings.

By referring again to FIGS. 1 and 3 of the drawings it will be seen that there are a pair of support rods 28 mounted on each end of the roller attachment adjacent the plates 17 and the front and back walls of the hollow beam 16. The support rods 26 are each positioned in a tubular guide 29 which has a cutaway opening inwardly of its ends in communication with a fluid motor and gear box 30 so that a gear 31 in each of the fluid motor and gear boxes 30 is positioned for registry with a rack 32 formed on the upper portion of each of the support rods 28. Communication means 33 extend from each of the fluid motor and gear boxes 30 and there are four of them, one adjacent each of the support rods 28 to a control valve, not shown, which in turn is connected to the hydraulic power system of the truck on which the device is positioned for operation.

It will thus be seen that by actuating the fluid motor and gear boxes 30 the support rods 28 may be moved vertically so as to engage the supporting surface and thereby hold the roller attachment or lift it as necessary to bring the brackets 26 into registry with the extensions 27 by which the roller attachment is attached to the dump truck. During operation the support rods are retracted to the positions illustrated in the Figures of the drawings.

Communication means 34 extend from each of the hydraulic piston and cylinders 14 and there are two of them, to a control valve 35 as seen in FIG. 1 of the drawings which also communicates with the hydraulic pressure system on the truck T.

Referring now to FIG. 2 of the drawings, it will be seen that vertically positioned guides 36 are positioned in spaced parallel pairs on the inner sides of the end plates 18 and slidably engage and guide extending portions of the bearings 12 which journel the shaft 11 carrying the roller 10.

As best seen in FIG. 2 of the drawings, it will be observed that the roller 10 is thus held in desirable position by the engagement of the bearings 12 which are actually bearing blocks with the guides 36 and the end plates 18.

It will occur to those skilled in the art that modifications in the structure disclosed herein can be made without departing from the spirit of the invention and one such modification could be the substitution of flexible cable driven means for moving the support rods 28 vertically for the fluid motors and gear boxes 30 hereinbefore described with a single fluid motor or the like for driving the flexible cable which could be continuous and engaged on all four of the actuating means for the four support rods.

It will thus be seen that a practical and efficient roller attachment for trucks has been disclosed in which a hollow main support beam 16 rigidly holds end assemblies including the plates 18, the right angular brackets 19 and the piston and cylinder assemblies 14 adjustably secured thereto and that the construction provides a freedom of operation enabling the roller attachment for trucks to be quickly and easily attached to or removed from a conventional dump truck or the like, and when attached thereto connected to the fluid power system thereof for actuation as hereinbefore described. The hollow beam 16 is provided with fittings so that it can be filled with oil such as used in coating the roller 10 when it is rolling blacktop materials and the oil or any other liquid carried in the hollow beam 16 adds to the effective weight of the device and insures the satisfactory performance of the roller in compacting road building materials and the like.

Although but one embodiment of the present invention has been illustrated and described, it will be apparent to those skilled in the art that various changes and modifications may be made therein without departing from the spirit of the invention.

Having thus described my invention what I claim is:

1. In a hydraulically operated roller attachment for mounting on a dump truck having a main frame and a hydraulically operated dump body thereon and a hydraulic fluid power system therefor, said roller attachment comprising the combination of a transverse hollow beam detachably secured to the truck main frame at a point below the rear end of the dump body, end plates secured to the ends of the transverse hollow beam for closing the same, vertically positioned hydraulic cylinder and piston assemblies secured to said transverse beam adjacent said end plates, vertical guide members on said end plates, movable means engaging said guide members, a roller positioned between said end plates in spaced, parallel relation to said transverse beam, axles on said roller engaging said movable means, piston rods of said piston and cylinder assemblies engaging said movable means for moving said roller toward and away from said transverse hollow beam.

2. The roller attachment set forth in claim 1 wherein sleeves are positioned between registering openings in said transverse hollow beam adjacent the ends thereof and wherein said hydraulic piston and cylinder assemblies are positioned partially within said sleeves and on the axial center line of said beam, means on said beam adjustably engaging the upper ends of said piston and cylinder assemblies.

3. The roller attachment for trucks set forth in claim 1 and wherein tubular guides are positioned in spaced vertical pairs on said end plates on either side of said transverse hollow beam and support rods are movably positioned in said tubular guides, means for moving said support rods vertically so that the roller attachment may be lifted thereby with respect to a supporting surface to facilitate attachment of the roller attachment to said truck.

4. The roller attachment for trucks set forth in claim 1 and wherein vertical passageways are formed in said transverse hollow beam and closed with respect to the interior thereof and right angular brackets are positioned on said transverse hollow beam engaging the upper surface thereof and in registry with said passageways and adjustable means on said right angular brackets attaching said piston and cylinder assemblies thereto.

* * * * *